United States Patent [19]

McGurty

[11] 4,086,085

[45] Apr. 25, 1978

[54] AUSTENITIC IRON ALLOYS

[76] Inventor: James A. McGurty, 101 J Colonial Dr., Reading, Pa. 19607

[21] Appl. No.: 788,396

[22] Filed: Apr. 18, 1977

Related U.S. Application Data

[63] Continuation-in-part of Ser. No. 737,758, Nov. 2, 1976, abandoned, which is a continuation-in-part of Ser. No. 537,357, Dec. 30, 1974, abandoned.

[51] Int. Cl.[2] ..... C22C 38/06

[52] U.S. Cl. ..... 75/124; 75/122; 75/128 A; 75/134 F; 148/31.5

[58] Field of Search ..... 75/122, 124, 125, 134 F, 75/128 A, 128 N, 128 W, 128 R, 128 G, 128 Z, 128 T; 148/31.5

[56] References Cited

U.S. PATENT DOCUMENTS

| | | | |
|---|---|---|---|
| 3,131,055 | 4/1964 | Behar | 75/124 |
| 3,362,813 | 1/1968 | Ziolkowski | 75/128 R |
| 3,754,898 | 8/1973 | McGurty | 75/128 E |

OTHER PUBLICATIONS

Cahm, "Physical Metallurgy," 1970, p. 602.

*Primary Examiner*—Arthur J. Steiner
*Attorney, Agent, or Firm*—Lawrence I. Field

[57] ABSTRACT

Austenitic iron base alloys containing nickel and with relatively high aluminum and chromium contents within ranges which are critical to the formation of an aluminum oxide protective film when the alloys are exposed to oxidizing environments at temperatures up to about 1700° F. The alloys exhibit excellent high temperature strength and oxidation resistance.

8 Claims, 1 Drawing Figure

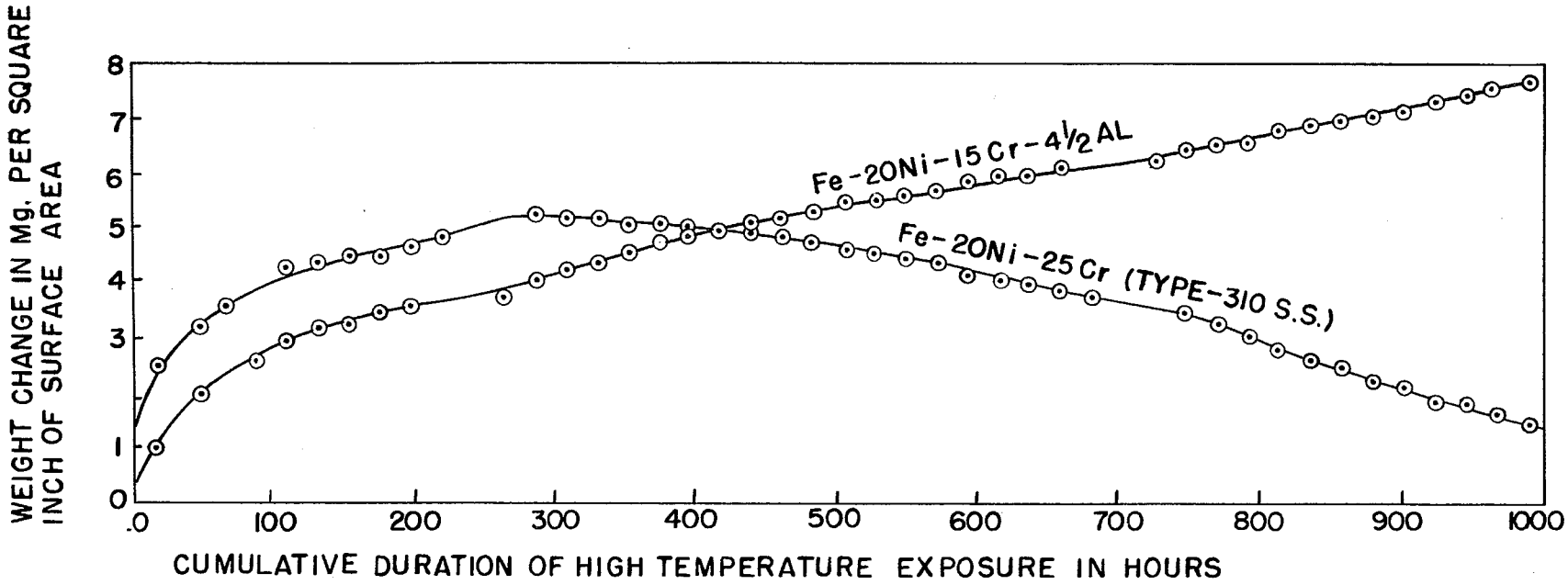
Fe-20Ni-15Cr-4½AL
Fe-20Ni-25Cr (TYPE-310 S.S.)
CUMULATIVE DURATION OF HIGH TEMPERATURE EXPOSURE IN HOURS
WEIGHT CHANGE IN Mg. PER SQUARE INCH OF SURFACE AREA
0
100
200
300
400
500
600
700
800
900
1000
1
3
4
5
6
7
8

AUSTENITIC IRON ALLOYS

This application is a continuation-in-part of my U.S. patent application Ser. No. 737,758 filed Nov. 2, 1976 which is a continuation-in-part of U.S. patent application Ser. No. 537,357 filed Dec. 30, 1974, both of which are now abandoned.

The alloys of this application are distinct from those described in my U.S. Pat. No. 3,754,898 in that they do not require the presence of yttrium. They are substantially fully austenitic by virtue of the balancing of the alloying constituents and contain no significant amounts of ferrite.

This invention relates to ductile, oxidation resistant austenitic iron alloys which exhibit excellent strength at high temperatures and whose oxidation resistance is based on the formation of an aluminum oxide protective film when exposed to oxidizing environments. More particularly, the invention relates to alloy compositions of iron, nickel, chromium and aluminum to which may be added manganese, copper, carbon, and/or nitrogen to minimize the nickel content required to obtain austenitic stability, and/or molybdenum, tungsten; columbium, tantalum, titanium, zirconium, hafnium, carbon and/or nitrogen to obtain improved high temperature strength.

This invention provides oxidation resistant alloys for high temperature technology which are stable at elevated temperatures and which are superior to conventional austenitic stainless steels since the aluminum oxide film which forms on the alloys of this invention provides superior non-spalling protection of the base metal as compared to the protective qualities of the relatively inferior chromium oxide film which forms on conventional austenitic stainless steels.

In an earlier issued U.S. Pat. No. 3,754,898 issued Aug. 28, 1973 I have described austenitic iron base alloys with relatively high aluminum and chromium contents which form an aluminum oxide protective film which protects the alloy at temperatures of 2000° F. These alloys contain small but significant amounts of yttrium and/or other rare earth elements. The presence of such constituents adds substantially to the cost of the alloy and requires certain precautions in the casting of the alloys, in order to avoid the loss of the yttrium by oxidation. Further, the presence of such elements impairs the otherwise excellent hot workability of the alloys at the higher temperatures used to work stainless steel alloys.

For these and other reasons it is desirable to attempt to produce other alloys with many of the properties of my patented alloys but without the disadvantages inherent in the presence of yttrium or other rare earth elements in such alloys.

In accordance with the present invention yttrium-free alloys are provided which form a protective aluminum oxide film which protects the alloys to about 1700° F in air, these alloys being achieved by balancing the contents of the austenite promoting elements and of the ferrite forming elements so as to produce an alloy which is fully austenitic as that expression is generally understood in the art, i.e., containing not more than 5% ferrite and usually less than 1% ferrite, and exhibiting all of the advantages associated with the austenitic structure.

Because of its allotropic properties iron forms two series of alloys. Depending on the addition of alloying elements these iron alloys are either ferritic or austenitic and differ significantly in crystal structure, alloying properties with respect to addition elements, thermal expansion, magnetic properties, mechanical properties, and hot and cold workability and fabricability. Generally ferritic alloys are magnetic, have low thermal expansion properties, poor high temperature strength and fair workability and austenitic alloys are non-magnetic, have high thermal expansion properties, good high temperature strength and excellent workability.

Iron is useful as a base metal for high temperature heat resistant alloys. However, iron reacts with oxygen at elevated temperatures and readily converts to iron oxides. The oxides formed are chemically weak and are readily reduced by other more reactive metals. Thus when iron alloys which contain other elements which are more reactive with oxygen than iron are heated in an oxidizing atmosphere the other elements when present in suitable concentrations will preferentially oxidize at the surface of the alloy. A barrier to further significant oxidation is obtained if the oxide film which forms is adherent and coherent.

Present day high temperature technology is principally based on the use of iron alloys which contain chromium and/or aluminum and whose oxidation resistance is dependent on the formation of aluminum oxide or chromium oxide protective films. The aluminum oxide film is the more protective film.

The wrought stainless steel alloys which are available commercially derive their corrosion resistance and oxidation resistance from their chromium content which provides for the formation of a surface $Cr_2O_3$ film.

The austenitic heat resistant alloys were discovered over forty years ago and the technology advanced since then has changed little over the intervening years except for minor changes e.g. to obtain improved chemical corrosion resistance (molybdenum additions — Type 316) and improved weldments (low carbon alloys and additions of Cb, Ta, and Ti). A better understanding of the important role of minor additions of carbon and nitrogen (usually present as impurities in the early alloys) for enhancing austenite stability and high temperature strength was also obtained. The original inventions resulted from the discovery that: (1) the high temperature form of iron could be stabilized to room temperature by a synergistic combination of chromium-nickel additions; (2) the high chromium contents required for austenite stabilization also provided corrosion resistance and oxidation resistance; and (3) the austenitic alloys possessed decisive ductility, strength and formability advantages as compared to competitive ferritic alloys.

That such alloys could exist was surprising since, while nickel is an austenite stabilizer, approximately 30% nickel is required to stabilize austenite (the high temperature form of iron) to room temperature. Chromium on the other hand is a ferrite stabilizer and when present in iron at levels above 13% stabilizes ferrite (the low temperature form of iron) at all temperatures. Thus an iron alloy containing 9% nickel would be austenitic at high temperatures and ferritic at low temperatures. An iron alloy containing 18% chromium would be ferritic at all temperatures. However, the synergistic combination of 9% nickel and 18% chromium in iron produces an alloy which is austenitic to room temperature. The alloy today is known as Type 302 stainless steel. This austenitic heat resistant alloy is useful to high temperatures in air because of the protective chromium oxide film which forms on the alloy under such service conditions. The market place attests to the advantage of the austenitic heat resistant steels over the ferritic (and martensitic) alloy steels in spite of the high cost and strategic problems which relate to the high nickel content of the austenitic alloys.

The present invention provides austenitic, heat resistant steel alloys which are useful at high temperatures in air. As compared to previously known austenitic stainless steel alloys, it has now been found that: (1) the high temperature form of iron can be stabilized to room temperature by a synergistic combination of nickel-chromium-aluminum additions, within specific proportions as herein after described; (2) the aluminum content provided must be sufficiently high for the formation of an $Al_2O_3$ protective film; and (3) the austenitic alloys obtained possess decisive ductility, strength and formability advantages as compared to competitive ferritic alloys.

The effects of nickel and chromium on austenite stability are discussed in the foregoing. Aluminum is a much stronger ferrite stabilizer than chromium. The addition of greater than 2% aluminum stabilizes ferrite at all temperatures. An iron alloy containing 20% Ni is austenitic at high temperatures and ferritic at low temperatures. An iron alloy containing 15% chromium or 4½% aluminum is ferritic at all temperatures. However, the synergistic combination of 20% Ni, 15% Cr, and 4½% aluminum produces an iron-base alloy which is austenitic to room temperature and possess the excellent hot and cold ductility of the 300 Series Stainless Steels. This alloy is useful to high temperatures in air because of the protective aluminum oxide film which forms on this alloy under such service conditions. This alloy thus differs from previously known austenitic heat resistant alloys in that an aluminum oxide film rather than a chromium oxide film protects the base metal.

The nature of the invention will be further apparent from the FIGURE filed with this application which is a graph showing the oxidation "resistance" at 1700° F under conditions of intermittent thermal cycling of a 20% Ni, 15% Cr, 4.5% Al, balance essentially all Fe, alloy of this invention based on weight change measurements as compared to the oxidation resistance of a 310 Stainless Steel alloy.

At 1700° F the aluminum oxide protective film which forms on the alloys of this invention does not spall under the severe thermal cycle conditions used in this test program. An aluminum oxide film protection of the base metals similar to that obtainable with the yttrium containing alloys of U.S. Pat. No. 3,754,898 issued Aug. 28, 1973, was found to be provided. The data shown graphically in the FIGURE provides a comparison of the oxidation resistance of the Fe—20Ni—15Cr—4.5Al alloy of this invention with the Fe—20Ni—25Cr alloy (Type 310 stainless steel) at 1700° F as a function of time and rapid thermal cycles to room temperature based on weight change measurements. Each datum point marks a thermal cycle occurrence. Type 310 Stainless Steel has the best oxidation resistance of the austenitic stainless steels and heat resistant alloys. The data show that the Fe—20Ni—15Cr—4.5Al alloy forms a non-spalling protective film which is highly protective of the base metal. At the end of this test surface oxidation of the base metal had penetrated to a depth of less than one ten thousandth of an inch. By contrast the Fe—20Ni—25Cr alloy is shown to have a higher oxidation rate. After 300 hours and 10 thermal cycles, spalling of the oxide film was found to occur with each thermal cycle and surface oxidation of the metal occurs at a rate of 3 to 5 times higher than that of the Fe—20Ni—15Cr—4.5Al alloy of this invention.

Based on superior oxidation resistance, especially the non-spalling properties of the aluminum oxide type protective film, the alloys of this invention are decisively superior to the most oxidation resistance heat resistant austenitic Fe—Ni—Cr alloy of commerce the Fe—20Ni—25Cr alloy (Type 310 stainless steel) for use at high temperatures in air to approximately 1700° F. It is thus shown that the non-yttrium alloys of this invention are superior to all other heat resistant alloys for such applications and as such are useful articles of commerce.

While not wishing to be bound by any specific theory, the function of the alloying additions in the quaternary Fe—Ni—Cr—Al base alloys of this invention is believed to be as follows: the nickel in association with the chromium content produces the desired austenite structure and the aluminum also in association with the chromium content provides for the formation of the aluminum oxide protective film when the alloy is heated to high temperatures in air. The austenitic iron base provides the low cost structure whose low temperature workability and fabricability and high temperature strength and workability are decisively superior to ferritic high aluminum containing alloys. The nickel and chromium content of the alloys of this invention are thus balanced to maintain the desirable austenite structure free of significant martensite (inadequate chromium content) or ferrite (excessive chromium content) which would adversely affect the ductility and fabricability of the alloys.

The austenite stability and room temperature ductility of the Fe—20Ni—15Cr—4.5Al quaternary base alloy are typical of the alloys of this invention in this respect. The alloy as cast exhibits the typical austenitic non-magnetic structure which persists throughout hot rolling. Annealing to obtain maximum room temperature ductility is accomplished by air or water quenching from 1800°-2000° F and yields a non-magnetic austenitic structure with a hardness of approximately 44R/A. Cold rolling increases the hardness to only 63R/A after 50% reduction. Continued cold rolling to a 75% reduction produces no loss of austenite stability and a final hardness of only 56R/A. Such austenite stability certainly compares favorably with that of the Type 300 Series Stainless Steels.

The lower nickel content alloys of this invention such as the Fe—20Ni—15Cr—4.5Al alloy like Type 310 stainless steels of commerce show some austenite instability when heated for long periods of time at temperatures of 1000° to 1200° F. Annealed alloy specimens heated for 24 hours at 1000° F and at 1200° F show slightly magnetic properties and room temperature hardness of 60R/A and 57R/A, respectively. This is indicative of only minor ferrite or martensite formation. Specimens heated for 24 hours at 400°, 600°, 800°, and 1600° F showed no evidence of instability. Increasing the nickel content of the alloys of this invention provides austenitic structures which are stable for special service requirement in the 1000° - 1200° F temperature range. The Fe—35Ni—15Cr—4.0Al alloy has austenite stability at all temperatures.

The compositional limits for defining the iron alloys of this invention which possess the required austenite stability and aluminum oxide protective film oxidation resistance may generally be defined as from about 16 to 45 w/o nickel, 4 to 25% chromium, and 3.5 to 5.5 w/o aluminum. A more preferred compositional range of alloys contain 18 to 35 w/o nickel, 10–20 w/o chromium, and 4 to 5 w/o aluminum. The lower nickel content alloys while economically the most attractive are alloys of somewhat lower austenite stability and oxidation resistance. The alloys which contain the higher aluminum and chromium contents have the best oxidation resistance, but require high nickel contents to obtain the required austenite stability. The highest nickel contents provide austenite stability at all temperatures. Such high nickel alloys are economically the least desirable but may be useful for special applications. I have found the most useful composition to be the Fe—20Ni—15Cr—4.5Al alloy.

For economic reasons it is for some applications desirable to lower the nickel content of some of the alloys of this invention to below the 16 w/o minimum of the quaternary Fe—Ni—Cr—Al compositions of this invention. It is well known that inexpensive manganese, carbon, nitrogen and copper promote austenite stabilization and can be used as a partial substitution for the more expensive nickel in austenitic stainless steels. The modified Schaeffer diagram of U.S. Pat. No. 3,152,938 issued Oct. 13, 1964, shows the nickel equivalent values of manganese, carbon, nitrogen, and copper as austenite stabilizers in the austenitic Fe—Ni—Cr alloys. These elements have similar nickel substitutional, austenite stabilizing properties when added to the Fe—Ni—Cr—Al alloys of this invention. It has been found that the content of strategic and expensive nickel can be lowered to below 16 w/o without loss of austenite stability by the addition to the alloy of manganese. An alloy with 15 w/o Ni, 15 w/o Cr, 4 w/o Al, 5 w/o Mn, balance iron was found to possess the desired ductile austenite stability and the strength and oxidation resistance typical of the non-manganese containing alloys of higher nickel content. The following have been found to be preferred compositions according to the present invention for those alloys in which a partial substitution for the nickel content of the alloys is made using other less costly austenite stabilizing elements: 8–45 w/o Ni, 4–25 w/o Cr, 3.5–5.5 w/o Al, 0–20 w/o Mn, 0–0.5 w/o C, 0–0.5 w/o N, and 0–1 w/o Cu, balance essentially iron.

Additions of carbon, nitrogen, molybdenum, tungsten, columbium, tantalum, titanium and zirconium are similarly effective for substantially improving the high temperature strength properties of the Fe—Ni—Cr—Al base alloys of this invention. The effectiveness of the various alloy additions in part have been determined by evaluations of the stress rupture properties of test alloys at elevated temperatures at a stress of 3000 psi. Using the determined stress rupture strength at 1700° F of the Fe—20Ni—10Cr—4Al alloy as a basis for comparison the following strengthening additions improve stress rupture life as follows:

The addition of 4 w/o tungsten or molybdenum increases stress rupture life by a factor of greater than five.

The addition of 5 w/o molybdenum increases stress rupture life by a factor of greater than 10.

Increasing the nickel content by 5% (to 25 w/o) and adding 4 w/o molybdenum or tungsten increases stress rupture life by a factor of greater than 20. The addition of 4 w/o molybdenum and 4 w/o tungsten increases stress rupture life by greater than a factor of 30.

An increase in nickel content beyond 25 w/o is deleterious for the 5 w/o molybdenum addition alloys. For nickel contents of 30 w/o and 35 w/o stress rupture life is increased only by factors of approximately 8 and 4, respectively.

For the alloy which contains only 15 w/o nickel, the addition of 5 w/o manganese and 1 w/o copper increases stress rupture life by over a factor of 19.

The addition of 2 w/o W, 2 w/o Mo, 1 w/o Cb, 0.2 w/o C, and 0.2 w/o N to the 20% nickel alloy and the 25 w/o nickel alloy increases stress rupture life by approximately a factor of 25 and 30, respectively.

The compositional limits which define the useful high temperature strength alloys of this invention may generally be defined as from about Fe, 8 to 45 w/o Ni, 4 to 25 w/o Cr, 3.5 to 5.5 w/o Al, 0 to 20 w/o Mn, 0 to 1 w/o Cu, 0 to 10 w/o W and/or Mo, 0 to 2 w/o Cb, and/or Ta, Ti, Zr, Hf and 0 to 0.5 w/o carbon and/or nitrogen.

Although the present invention has been described in preferred embodiments, it is to be understood that modifications and variations may be resorted to without departing from the spirit and scope of the invention as those skilled in the art will readily understand. Thus, the alloys of this invention may also contain small amounts of sulfur, phosphorus, silicon and/or tellurium either as impurities or as intentionally added elements, provided deliberately to afford some specific property or properties. The alloys may contain small amounts of cobalt, for example, added in place of nickel, without departing from the intended scope of the invention. Such modifications and variations are considered to be within the purview and scope of the invention and appended claims.

I claim:

1. A high temperature yttrium-free, austenitic iron alloy which forms an aluminum oxide film which is protective of the base metal to 1700° F in air consisting essentially of 20.0 weight percent of nickel, 15.0 weight percent chromium, 4.5 weight percent of aluminum and the balance consisting essentially of iron.

2. A high temperature yttrium-free, austenitic iron alloy which forms an aluminum oxide film which is protective of the base metal to 1700° in air consisting essentially of 18.0 to 35.0 weight percent of nickel, 10.0 to 20.0 weight percent of chromium, and 4.0 to 5.0 weight percent of aluminum and the balance consisting essentially of iron.

3. A high temperature, yttrium-free, austenitic iron alloy consisting essentially of 16.0 to 45.0 weight percent of nickel, 4.0 to 25.0 weight percent of chromium, 3.5 to 5.5 weight percent of aluminum and the balance consisting essentially of iron the contents of said nickel, chromium, iron and aluminum in said alloy being balanced so as to form an oxide film consisting of aluminum oxide when said alloy is exposed to an oxidizing environment at elevated temperatures up to 1700° F, said film being protective of said alloy to 1700° F.

4. A high temperature yttrium-free, austenitic iron alloy which forms an aluminum oxide film which is protective of the base metal to 1700° F in air consisting essentially of 15.0 weight percent nickel, 15.0 weight percent chromium, 4.0 weight percent aluminum, 5.0 weight percent manganese and the balance consisting essentially of iron.

5. A high temperature, yttrium-free, austenitic iron alloy consisting essentially of 8.0 to 45.0 weight percent nickel, 4.0 to 25.0 weight percent chromium, 3.5 to 5.5 weight percent aluminum and containing 0 to 20.0 weight percent manganese, 0 to 0.5 weight percent carbon, 0 to 0.5 weight percent nitrogen and 0 to 1.0 weight percent copper with the balance consisting essentially of iron, the composition of the constituents in said alloy being balanced so as to form an oxide film consisting of aluminum oxide when said alloy is exposed to an oxidizing environment at elevated temperatures up to 1700° F, said film being protective of said alloy to 1700° F.

6. A high temperature, yttrium-free, austenitic iron alloy consisting essentially of 8.0 to 45.0 weight percent nickel, 4.0 to 25.0 weight percent chromium, 3.5 to 5.5 weight percent aluminum, and containing 0 to 20.0 weight percent manganese, 0 to 0.5 weight percent carbon, 0 to 0.5 weight percent nitrogen as a partial substitution of the austenite stabilizing nickel content and the following for increasing high temperature strength: 0 to 10.0 weight percent tungsten, 0 to 10 weight percent molybdenum, and 0 to 2.0 weight percent of at least one element selected from the group consisting of columbium, tantalum, titanium, zirconium, and hafnium, the balance consisting essentially or iron, the composition of the constituents in said alloy being balanced so as to form an oxide film consisting of aluminum oxide when said alloy is exposed to an oxidizing environment at elevated temperatures up to 1700° F, said film being protective of said alloy to 1700° F.

7. A high temperature yttrium-free, austenitic iron alloy which forms an aluminum oxide film which is protective of the base metal to 1700° F in air consisting essentially of 18 to 35 weight percent nickel, 10 to 20 weight percent chromium, 4 to 5 weight percent aluminum and containing 0 to 20 weight percent manganese, 0 to 0.5 weight percent carbon, 0 to 0.5 weight percent nitrogen and 0 to 1.0 weight percent copper with the balance consisting essentially of iron.

8. A high temperature yttrium-free, austenitic iron alloy which forms an aluminum oxide film which is protective of the base metal to high temperatures up to about 1700° F in air consisting essentially of 18 to 35 weight percent nickel, 10 to 20 weight percent chromium, 4 to 5 weight percent aluminum, and containing 0 to 20.0 weight percent manganese, 0 to 0.5 weight percent carbon, 0 to 0.5 weight percent nitrogen as a partial substitution for the austenite stabilizing nickel content and the following for increasing high temperature strength: 0 to 10.0 weight percent tungsten, 0 to 10 weight percent molybdenum, and 0 to 2.0 weight percent of at least one element selected from the group consisting of columbium, tantalum, titanium, zirconium, and hafnium, the balance consisting essentially of iron.

* * * * *